United States Patent [19]
Peirson et al.
[11] 4,194,328
[45] Mar. 25, 1980

[54] BUILDING CONSTRUCTION

[75] Inventors: John R. Peirson; Deane A. L. Lynch, both of Peterborough, Canada

[73] Assignee: J. R. Pierson Building Systems Limited, Peterborough, Canada

[21] Appl. No.: 867,286

[22] Filed: Jan. 5, 1978

[51] Int. Cl.[2] ..... E04B 1/32
[52] U.S. Cl. ..... 52/86; 52/236.6; 52/404
[58] Field of Search ..... 52/82, 86, 73, 80, 407, 52/408, 404, 236.6; D25/17, 56

[56] References Cited

U.S. PATENT DOCUMENTS

| | | | |
|---|---|---|---|
| 2,169,474 | 8/1939 | Pederson | 52/86 |
| 2,287,400 | 6/1942 | Wells, Jr. | 52/407 X |
| 2,407,252 | 9/1946 | Closs | 52/86 |
| 2,480,642 | 8/1949 | Galloway | 52/86 |
| 3,438,163 | 4/1969 | Vevoda | 52/408 X |
| 3,780,477 | 12/1973 | Sprung, Jr. | 52/86 |

FOREIGN PATENT DOCUMENTS

| | | | |
|---|---|---|---|
| 57003 | 12/1974 | Australia | 52/86 |
| 462253 | 1/1950 | Canada | 52/86 |
| 1023121 | 12/1977 | Canada | 52/80 |
| 2204563 | 8/1973 | Fed. Rep. of Germany | 52/86 |
| 509439 | 7/1939 | United Kingdom | 52/86 |
| 776736 | 6/1957 | United Kingdom | 52/73 |

*Primary Examiner*—Alfred C. Perham

[57] ABSTRACT

Home building construction is characterized in a combination sidewall and roof extending from the building base to peak over the length of the building. The combination sidewall and roof provides internally of the home a continuous surface on which a sheet of air-vapor barrier extends from building base to top over insulation material positioned between the rafters. The connection between the barrier sheets is essentially impervious to prevent moisture laden air within the building migrating through the barrier. A pair of support beams are fastened horizontally to the respective sidewall at normal first storey ceiling height to provide a two-storey building. Each support beam has a barrier sheet affixed to its inside surface prior to installation. The air-vapor barrier overlying the insulation is affixed to the air-vapor barrier on the beam at its top and bottom and is so connected to provide an essentially impervious barrier to moisture laden air within the building.

10 Claims, 6 Drawing Figures

FIG. 5.
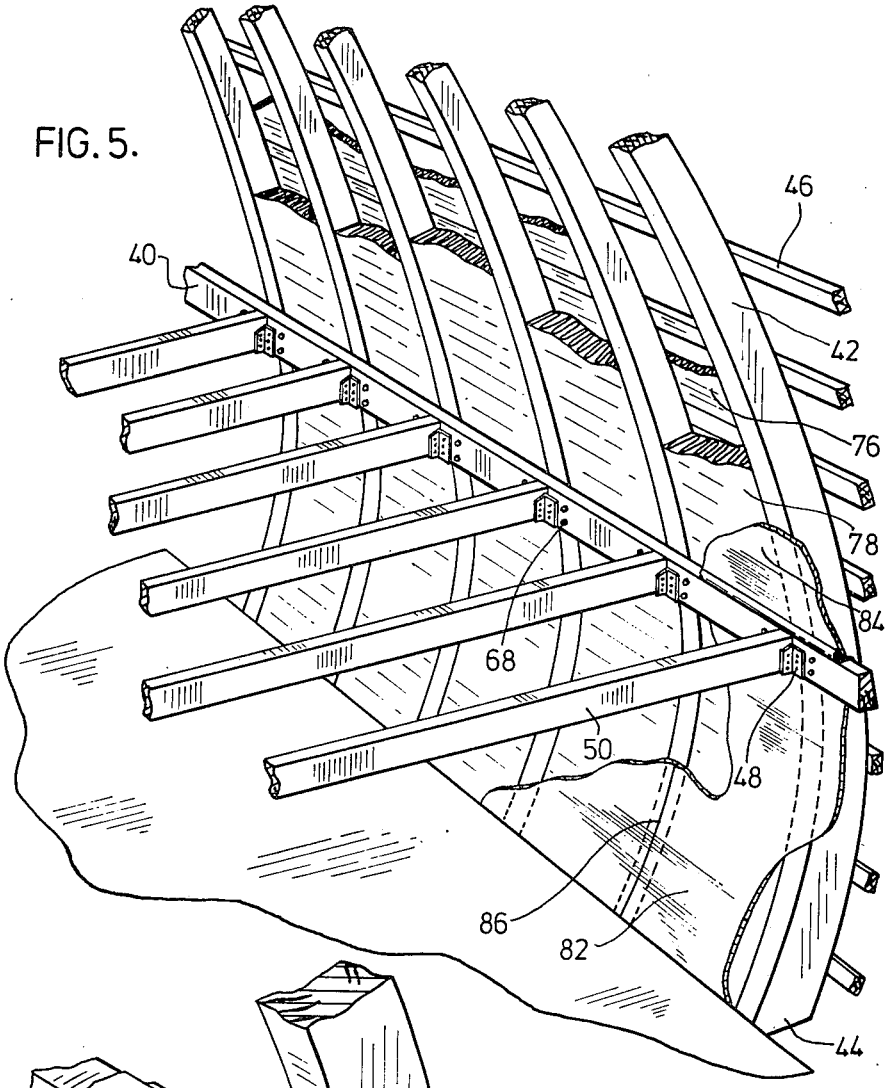
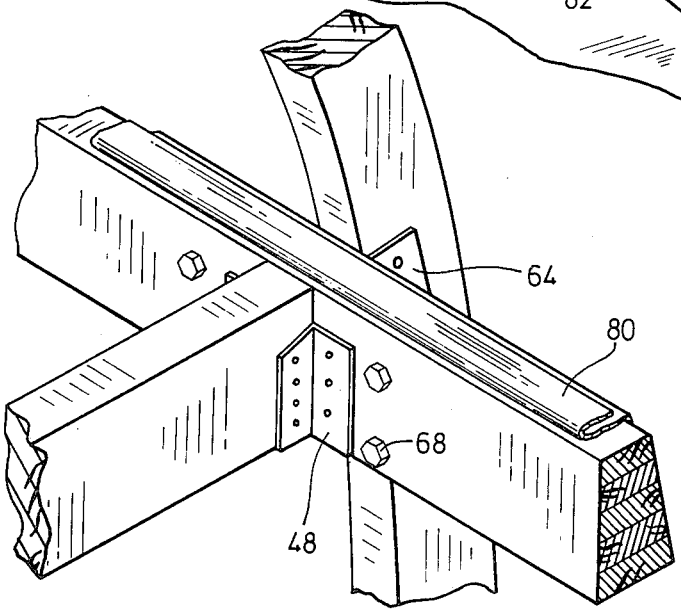
FIG. 4.

BUILDING CONSTRUCTION

This invention relates to building construction.

Most buildings for use in communities having lengthy winters are the heavily insulated cottage-type. These have proved to be inefficient in terms of energy required to heat the building in very cold climates. These buildings are usually prefabricated and are constructed of a series of units interconnected on site. Such interconnection of building units proves to be structurally weak and results in poor thermal insulation properties. Also with such prefabricated construction it is necessary to work with a single storey building because of its complexity and shipping bulk. However, prefabricated buildings are particularly attractive in cold climates because they can be constructed by unskilled workmen during short summer months.

The building construction according to this invention provides a building package which is easily constructed on site, can be adapted for two-storey use and may be shipped at a cost equivalent to that for a single storey prefabricated dwelling. The unit proves to be more efficient in terms of heat energy required so that it is most desirable for use in cold climates. The structure of the building is such that it resists build-up of snow on the roof due to its particular shape. Due to the type of building construction, the building may be of any size to accommodate consumer's desire.

The home building construction according to this invention has a combination sidewall and roof extending from the building base to the building peak. Such combination may be referred to as the sidewall of the building which extends for the length of the building. The sidewall is constructed from a plurality of spaced apart integral rafters or beams which extend from the building base to the building top. The sidewall as such provides internally of the building a continuous surface on which sheets of barrier material extend from the building base to top over insulation material positioned between such rafters. The barrier sheets which may be integral with the insulation are connected in a manner to prevent or substantially retard migration of air within the building to outside the building.

The building construction can be adapted to provide a two-storey building. A pair of ceiling joist support beams are fastened horizontally to the sidewalls at normal first storey ceiling height. Each support beam has barrier material affixed to its inside surface prior to installation on a respective sidewall. Barrier material overlies the insulation and is affixed to the interior of the sidewall. The additional air-vapor barrier extends from the building bottom to top and is connected to the barrier on the horizontal beams above and below such beams. The connections of the barrier are essentially impervious to air to present a continuous barrier to moisture laiden air internal of the building.

According to another aspect of the invention the building sidewall may be bulged outwardly at the first floor area to provide for optimum useage of first floor area and to provide a point for water run off on the exterior of the building which is spaced outwardly from the building base.

According to yet another aspect of the invention the upper portions of the sidewall or combination sidewall and roof are inclined linearly from the curved portion to provide a building peak. Such arrangement has been found to place the building sides in suction to minimize the amount of snow build-up on the roof.

These and other features advantages of the invention will become apparent in the following detailed description of the preferred embodiment of the invention as shown in the drawings wherein:

FIG. 4 is a detail showing a section of the joist support beam connected to a rafter and having a joist end held by a joist hanger;

FIG. 5 shows an aspect of the invention with insulation positioned between the rafters and barrier material covering the insulation.

Figure 1:
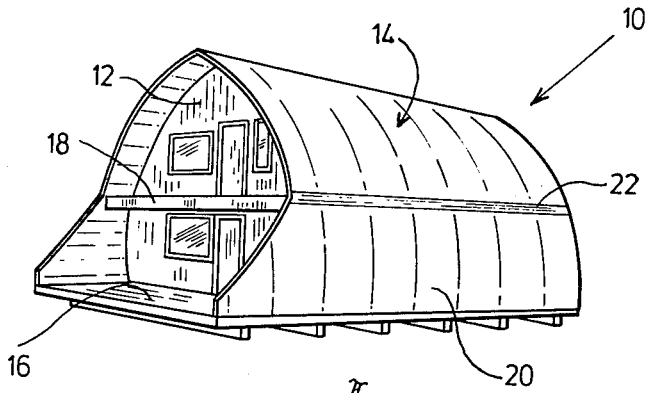
FIG. 1 is a perspective view of the building construction as assembled.

The building construction as assembled is shown in FIG. 1. The building 10 has vertical endwalls 12 and curved opposing sidewalls generally designated 14. These may be considered as a combination sidewall and roof for the building. The building includes an entrance patio 16 and in this particular embodiment includes a second floor with a second floor deck 18. Appropriate entrance door and windows are as shown. The exterior of the building is covered with prepainted metal cladding which runs vertically on the building as indicated by the vertical lines 20. The sidewalls 14 include flashing 22 extending the length of the sidewalls 14 to provide a break in the sidewall to permit useage of two lengths of sheet in covering the sidewall and to provide a colour break in the sidewall for aesthetic purposes. The building is particularly useful in Artic or cold climates where the rear left corner of the building as seen from the front is directed into the prevailing winds. In the northern hemisphere this usually locates the front of the building towards a southern exposure.

Figure 2:
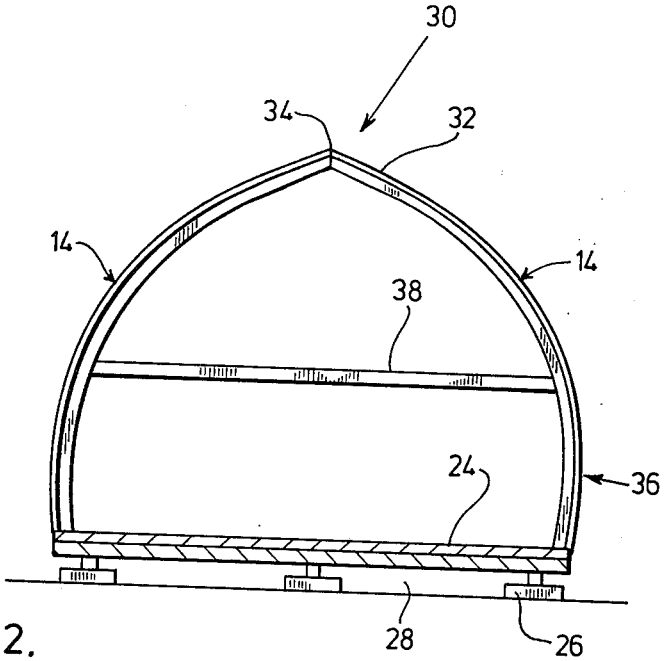
FIG. 2 is a section through the building to show the shape of the opposing sidewalls.

As is shown in FIG. 2, the building base or foundation 24 is mounted on a series of wooden pads 26 which are positioned on a granular base. As is understood in northern climates the building must be spaced above the ground to provide an air space 28 which prevents melting of the permafrost. In the embodiment shown, the sidewalls 14 are curved over a substantial part. The upper portion thereof includes a linear portion 32 which is inclined linearly upwardly to define a peak 34. It has been found that with this particular shape for the exterior of the building the leaward sidewall is under suction which precludes build-up of snow on that side. This is particularly important in climates where there is substantial snow fall.

To provide for optimum useage of the floor space on the first floor of the building, the sidewall is bulged outwardly in the area 36 so that a person of normal height may stand at and move along the sides of the building. A second floor 38 is located in the building at the normal first floor ceiling height which may be approximately 7 or 8 feet. The outwardly bulging portion 36 of the sidewall also provides an area for rainfall run-off which is spaced outwardly from the building base. This eliminates the need for eavestroughing and prevents build-up of water around the building base and avoids migration of water into seams along the building base.

With this particular building shape, it results in a ratio of sidewall area to floor area of approximately 1.7:1. This is highly advantageous compared to prior art prefabricated one-storey buildings which usually have a ratio of sidewall and roof area to floor area of approximately 2:1. With the lesser ratio of this invention, heating of the building can be 60 to 65% of that required to heat a normal prefabricated one-storey building.

Figure 6:
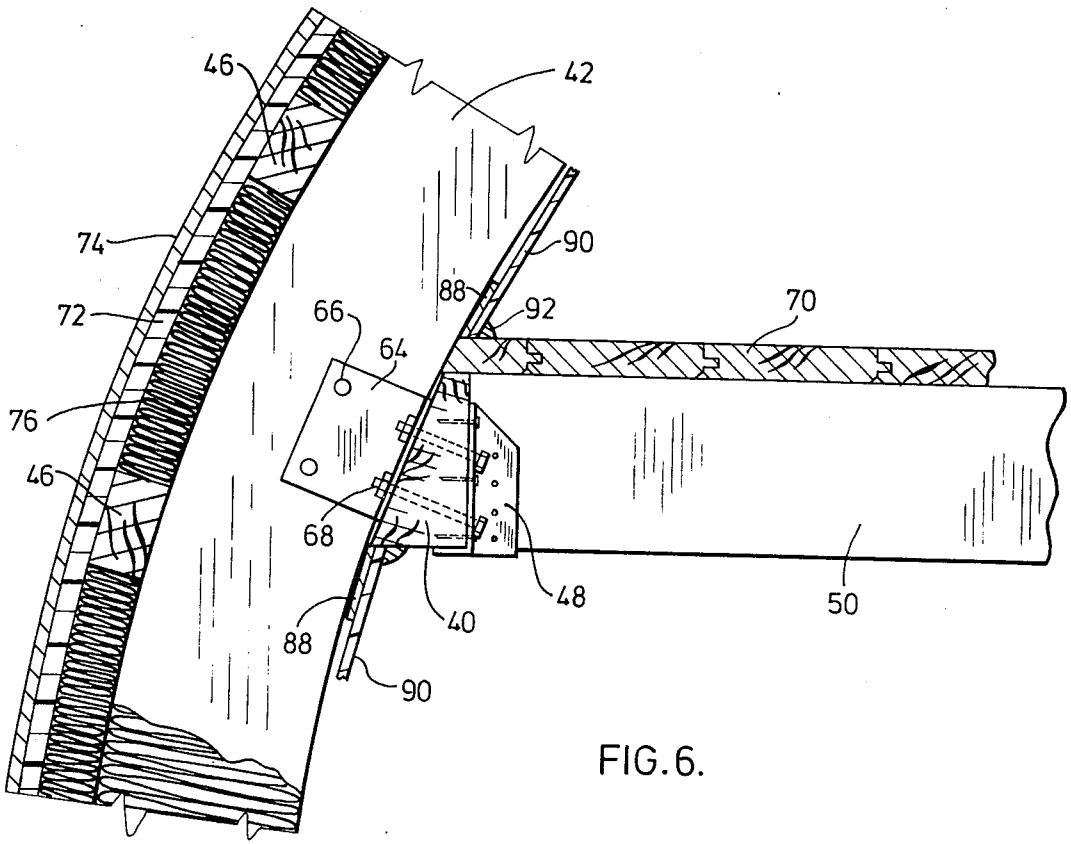
FIG. 6 is a detail showing the second floor as connected to the rafters and insulation material located between the outer skin and the rafters.

The details of the construction of the sidewall and the suspension of the second floor joist on the sidewall is shown in FIGS. 4, 5, and 6. Turning to FIG. 5, as can be appreciated, the rafters 42 are laminated and of a shape as depicted in FIG. 2. The laminated rafters are positioned in a shoe at their base 44 and are interconnected at their tops by plate and bolts. Two-by-three strapping 46 interconnects the rafters 42. The joints in the strapping 46 are staggered so as to enhance the structural strength of the building. The strapping is spaced apart upwardly along the rafters 42 in the manner shown. The rafters may be conveniently located at 2 foot centres to accommodate insulation and similarly the straping 46 may be spaced at 16 inch centres to accommodate insulation between them.

Joist hangers 48 are secured to the joist support beams 40 at intervals along its length, which may be at 2 foot centres. The ceiling joist 50 are located in the hangers and securely fastened thereto.

Figure 3:
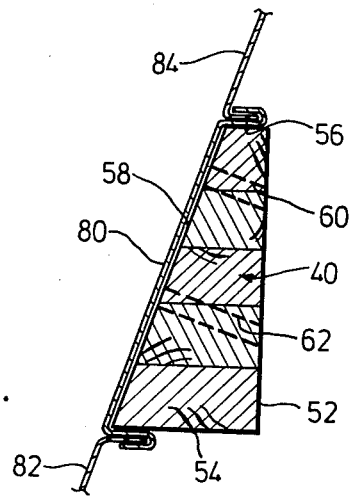
FIG. 3 illustrates a preferred embodiment of the ceiling joist support beam for use in the building of FIG. 1.

In this embodiment the horizontal beam 40 or what is commonly referred to as the ledger beam 40, may be laminated as shown in FIG. 3. The beam has an outer vertical face 52, a lower horizontal face 54 and an upper horizontal face 56. The inner face of the beam 58 may be inclined in the manner shown and so arranged such that when the beam is fastened to the rafters 42 the outer face 52 is presented in a vertical plane to facilitate attachment of the ceiling joist 60 to the joist hangers 48. The ledger beam 40 has holes 60 and 62 drilled therethrough so as to be perpendicular to the inclined face 58. Secured to rafters 42 are a plurality of plates 64 which are L-shaped and are shown in FIGS. 4 and 6. The L-shaped plates are located on each side of the rafters at a prescribed height and they are bolted to the rafters at 66 and are bolted to the ledger beam through apertures 60 and 62 by bolts 68 in the manner shown in FIGS. 4, 5, and 6. As is apparent in this embodiment, the joist hanger 48 is of a width substantially less than the distance between the bolts 68 so that the joist 50 may be located at 2 foot centres in line with the rafters 42. As is shown in FIG. 6, the second floor of the building has tongue and groove sheeting 70 which is nailed to ceiling joist 50.

The structure of the building can be shipped in component form to the site and can be readily assembled on site. The rafters and supporting beams are prefabricated to ensure the structural integrity of the building. The building assembly is such that its members are tied together in a manner which forms a rigid structure for withstanding high winds and building shifting. This is superior to the normal prefabricated housing.

After the structure has been assembled and all of the 2×3 strapping 46 securely nailed to the rafters, the outer skin is applied. Turning to FIG. 6, the outer skin consists of a layer 72 of "TENTEST" (trademark). This material usually comes in 4×8 sheets and is secured to strapping 46 by nails. Laid over the "TENTEST" 72 is a layer of felt paper which provides a degree of waterproofness to the roofing. Laid on top of this material is a series of sheets of prepainted steel 74 which may be provided in 3×8 and 3×15 foot sheets. As shown in FIG. 1 the 3×8 sheets extend from the building base up to flashing 22, then supermost of flashing 22 are the 3×15 foot sheets to complete covering of the sidewalls. It is desirable to begin the metal sheeting at the front of the building so that the metal laps are shielded from the prevailing winds. The metal sheeting may have ridges generally indicated by lines 20 which act as drainage valleys for the building sidewall.

After the outer skin has been applied to the building and the endwalls have been completed and covered, insulation of the building is begun. The first part of the sidewall to be insulated is the area between the rafters 42 and the outer skin of "TENTEST" 72. As shown in FIGS. 5 and 6, a layer of insulation 76 is located horizontally between the strapping 46.

Bats 78 of insulation are placed between the rafters 42 as shown in FIG. 5. With a preferred embodiment of the building construction, the rafters may be 7½ inches thick so that a single bat of 7½ inch thickness may be used or the 7½ inches may be built up with a bat of 4" insulation and a bat of 3½" insulation. As can be appreciated by those skilled in the art, the insulation may be in rolls. The 4" layer of insulation is located in the space between the rafters and run from the building base to the building top. The remaining 3½" insulation bat is placed between the rafters to complete the insulation. The inside surface of the building is now covered with an airvapor barrier. According to an aspect of this invention, the 3½" bat of insulation may have the barrier material affixed to it. Such barrier material may be an aluminum foil with fabric reinforcement. As shown in FIG. 5, the barrier material is run from the building base up to the bottom of beam 40 and then continued from the top of the beam 40 to the building peak.

The barrier material is provided on the horizontal beam 40 prior to its installation. Turning to FIG. 4 the barrier 80 is affixed to the ledger beam and a sufficient amount of the barrier sheet lies freely above and below the beam. The barriers 82 and 84 which are above and below the beam are then affixed to barrier 80. Turning to FIG. 3 it can be seen that the barrier sheet 82 is rolled in with the barrier sheet 80 and stapled to surface 54 to form a connection which is essentially impervious to moisture laiden air. A similar connection is made between the barrier sheets 84 and 80.

In the instance where the barrier sheets 82 and 84 are affixed to the insulation, then adjoining sheets are attached at seams 86 at each rafter location in a manner similar to that shown in FIG. 3. After stapling of the seams 86, they are taped to render the seams essentially impervious to air and moisture. In order to reduce the number of seams 86, rolls of barrier material may be used in place of the barrier sheets affixed to the insulation. Such rolls of material may be 8 to 12 feet in width. The material is laid over the insulation and run from building base to top. The seams between the rolled barrier material may be stapled and taped. The rolled material may be any suitable sheeting such as polyethylene, foil coated polyethylene, aluminum foil with fiber reinforcing etc. The material should have some resistance to tear and puncture and should be easy to repair by using tape with an adhesive backing.

This type of building construction provides an internal surface on which a continuous air-vapor barrier can be fastened from the building base to building top. This prevents or substantially retards the migration or movement of moisture laiden air from within the building through the walls into the insulation. This avoids condensation and frosting in the insulation so that the insulation remains dry to ensure maximum insulation values.

Subsequent to completion of the barrier, strapping 88 as shown in FIG. 6, is run horizontally along the inner surface of the building. Attached to strapping 88 is the wall paneling 90 which provides a complete finish for the building interior. As is also shown, corner-round 92 is provided at joints to give a finished appearance to the building interior.

Although various aspects of the invention have been discussed herein in detail with respect to the preferred embodiment, it is understood that variations may be made thereto as would be understood by those skilled in the art without departing from the spirit of the invention or the scope of the appended claims.

What is claimed is:

1. In home building construction having rectangular floor plan, combination sidewall and roof extending from the building base to building peak, a substantial portion of said combination sidewall and roof being curved with its lower portion bulging outwardly, the remaining portion of said combination sidewall and roof being inclined linearly upwardly from said substantial portion to define the building peak, said combination sidewall and roof being constructed of a plurality of spaced apart parallel laminated rafters which extend from building base to peak, said combination sidewall and roof providing internally of said home a continuous surface on which a sheet of air-vapor barrier extends from building base to top over insulation material positioned between said rafters, the connection between sheets of barrier material being essentially impervious to moisture laiden air to prevent movement of air from within said building to outside said building.

2. In home building construction of claim 1, the exterior of said combination sidewall and roof following the outline of said bulged portion to provide for water run-off from the building sidewall exterior at a point spaced outwardly from the building base.

3. In home building construction of claim 1, the curved portion of said combination sidewall and roof being circular with its centre position above the building bottom to thereby provide said bulging portion, said linear portion extending through approximately 20° relative to said centre.

4. In two-storey building construction, opposing sidewalls extending from building bottom to top and extending along the building's length, each sidewall being essentially curved along its extent from building bottom to top, each sidewall being constructed from a series of spaced-apart curved laminated beams, said beams being interconnected at their tops to opposing beams, insulation material located between said beams and extending from building bottom to top, a pair of ceiling joist support beams, each fastened horizontally to a sidewall at normal first storey ceiling height, each joist support beam having an air-moisture barrier material affixed to its inside surface prior to installation on a respective sidewall, additional barrier material overlying said insulation and affixed to said beams in the sidewalls as such barrier extends from building bottom to top, the additional barrier being connected to said barrier which is affixed to the respective horizontal beam, above and below such beam, each connection of barrier being essentially impervious to water vapor to present a continuous barrier to movement of air interior of the building to external of the building.

5. In two-storey building construction of claim 4, said joist support beam having an inner slanted surface adapted to present a vertical outer face after installation on a respective sidewall, said barriers being connected at the top and bottom surfaces of said joist support beam.

6. In two-storey building construction of claim 4, said barrier being in sheets of a width wider than the spacing between said rafters, the barrier sheets being connected to one another along the rafter.

7. In two-storey building construction of claim 6, said barrier sheet being attached to the layer of insulation positioned between said rafters.

8. In two-storey building construction of claim 4, the ratio of sidewall area to floor area being approximately 1.7:1.

9. In two-storey building construction of claim 4, said sidewall having a substantial curved portion and a minor linear portion, said curved portion being circular with its centre located above the building base to provide an outwardly bulging sidewall portion in the first floor area, said linear portion being inclined upwardly from said curved portion through approximately 20° relative to said centre to define a building peak at its top.

10. In two-storey building construction of claim 4 said barrier being polyethylene sheeting.

* * * * *